US008977142B2

(12) United States Patent
Uwatoko

(10) Patent No.: US 8,977,142 B2
(45) Date of Patent: Mar. 10, 2015

(54) MALFUNCTION INFERRING APPARATUS, MALFUNCTION INFERRING METHOD, AND NON-TRANSITORY COMPUTER READABLE MEDIUM

(71) Applicant: Fuji Xerox Co., Ltd., Minato-ku, Tokyo (JP)

(72) Inventor: Koki Uwatoko, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 162 days.

(21) Appl. No.: 13/739,837

(22) Filed: Jan. 11, 2013

(65) Prior Publication Data

US 2014/0010558 A1 Jan. 9, 2014

(30) Foreign Application Priority Data

Jul. 9, 2012 (JP) ..... 2012-153185

(51) Int. Cl.
*G03G 15/00* (2006.01)

(52) U.S. Cl.
CPC ..... *G03G 15/553* (2013.01); *G03G 15/5079* (2013.01); *G03G 15/55* (2013.01)
USPC ..... 399/9; 399/8

(58) Field of Classification Search
CPC ..... G03G 15/55; G03G 15/5079; G06F 11/0733; G06F 11/3447; G06F 11/008
USPC ..... 399/18, 10, 21, 31, 9, 33, 34, 8, 42; 706/52; 714/26, 48
See application file for complete search history.

(56) References Cited

U.S. PATENT DOCUMENTS 7,865,089 B2 * 1/2011 Andreoli et al. ..... 399/8
2008/0068639 A1 3/2008 Satoh et al.

FOREIGN PATENT DOCUMENTS

JP 2008-102470 A 5/2008

* cited by examiner

*Primary Examiner* — Blake A Tankersley
(74) *Attorney, Agent, or Firm* — Sughrue Mion, PLLC

(57) ABSTRACT

A malfunction inferring apparatus includes an obtaining unit and an inferring unit. The obtaining unit obtains, from a first image forming apparatus and a second image forming apparatus which are used alternatively with each other by plural users, a first usage status of the first image forming apparatus and a second usage status of the second image forming apparatus. If a first change occurs in the first usage status and if a second change corresponding to the first change occurs in the second usage status, the inferring unit infers that a malfunction has occurred in any one of the first image forming apparatus and the second image forming apparatus, in accordance with the first usage status and the second usage status obtained by the obtaining unit.

7 Claims, 4 Drawing Sheets

FIG. 3

| USER NAME | FILE NAME | COLOR | MONOCHROME | DATE AND TIME OF EXECUTION |
|---|---|---|---|---|
| USER A | aaa.doc | 2 | 0 | 3/1/2012 10:01:10 |
| USER B | bbb.ppt | 5 | 0 | 3/1/2012 10:12:05 |
| USER A | ccc.xls | 0 | 2 | 3/1/2012 11:30:12 |
| USER C | ddd.doc | 10 | 3 | 3/1/2012 12:10:45 |

⋮

MALFUNCTION INFERRING APPARATUS, MALFUNCTION INFERRING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2012-153185 filed Jul. 9, 2012.

BACKGROUND (i) Technical Field

The present invention relates to a malfunction inferring apparatus, a malfunction inferring method, and a non-transitory computer readable medium.

(ii) Related Art

Image forming apparatuses having an image forming function of forming an image of a document on a recording medium such as a sheet and outputting it are available, for example, a printer (document printing apparatus), a copier (document copying apparatus), and a facsimile apparatus (document transfer apparatus).

In these image forming apparatuses, if a malfunction which interferes with operation of an image forming function (paper jam, faulty transfer, or the like) occurs, usage of the image forming function is limited, which is inconvenient for a user. Thus, it is demanded to infer the occurrence of such a malfunction and immediately take necessary measures such as replacement or repair of a component after the occurrence of the malfunction, thereby shortening a period of time in which usage of the image forming function is limited.

SUMMARY

According to an aspect of the invention, there is provided a malfunction inferring apparatus including an obtaining unit and an inferring unit. The obtaining unit obtains, from a first image forming apparatus and a second image forming apparatus which are used alternatively with each other by plural users, a first usage status of the first image forming apparatus and a second usage status of the second image forming apparatus. If a first change occurs in the first usage status and if a second change corresponding to the first change occurs in the second usage status, the inferring unit infers that a malfunction has occurred in any one of the first image forming apparatus and the second image forming apparatus, in accordance with the first usage status and the second usage status obtained by the obtaining unit.

BRIEF DESCRIPTION OF THE DRAWINGS

An exemplary embodiment of the present invention will be described in detail based on the following figures, wherein:

FIG. 3 is a diagram illustrating an example of attribute information used in the malfunction inferring system;

DETAILED DESCRIPTION

An exemplary embodiment of the present invention will be described with reference to the drawings.

Figure 1:
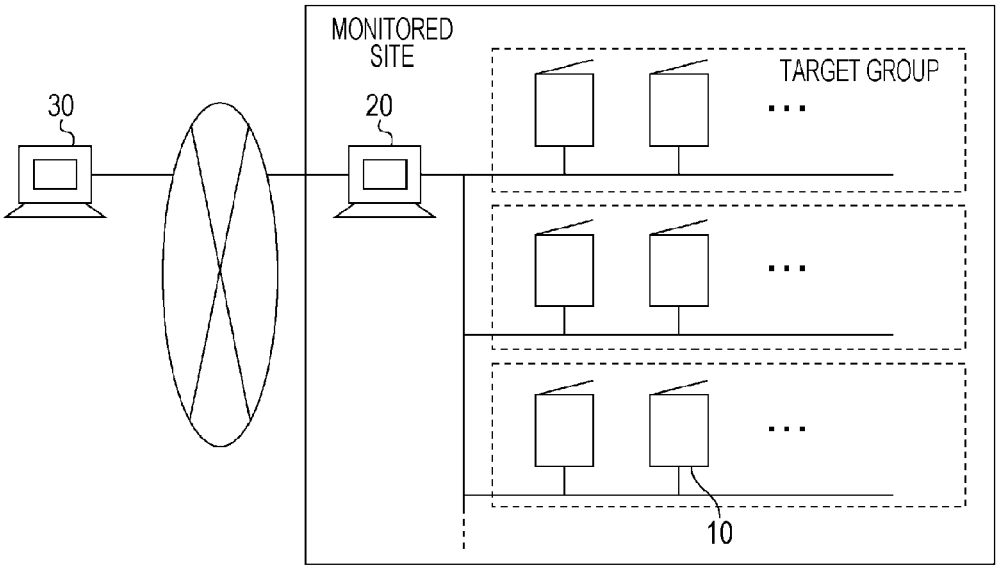
FIG. 1 is a diagram illustrating an example configuration of a malfunction inferring system according to an exemplary embodiment of the present invention.

FIG. 1 illustrates an example configuration of a malfunction inferring system that infers the occurrence of a malfunction in plural image forming apparatuses which are targets to be monitored.

In this example, description will be given of a configuration in which printers (document printing apparatuses) that execute a print job in response to a print instruction provided from a user terminal are used as the image forming apparatuses to be monitored. Alternatively, copiers (document copying apparatuses), facsimile apparatuses (document transfer apparatuses), or multifunction peripherals having the functions of these apparatuses may be used as the image forming apparatuses to be monitored.

The malfunction inferring system according to this example includes management apparatuses 20 that infer the occurrence of a malfunction in plural image forming apparatuses 10 to be monitored, which are set in individual monitored sites. Each management apparatus 20 is provided for a corresponding one of the monitored sites, and is connected to a remote center server 30 so as to be capable of communicating therewith.

The image forming apparatuses 10 in each monitored site are grouped into plural target groups to be monitored. Each of the target groups is a group of plural image forming apparatuses 10 which are interchangeable with one another, for example, a group corresponding to a certain floor or a certain area. It means that a user could use one of the plural image forming apparatuses 10 as he or she likes.

Figure 2:
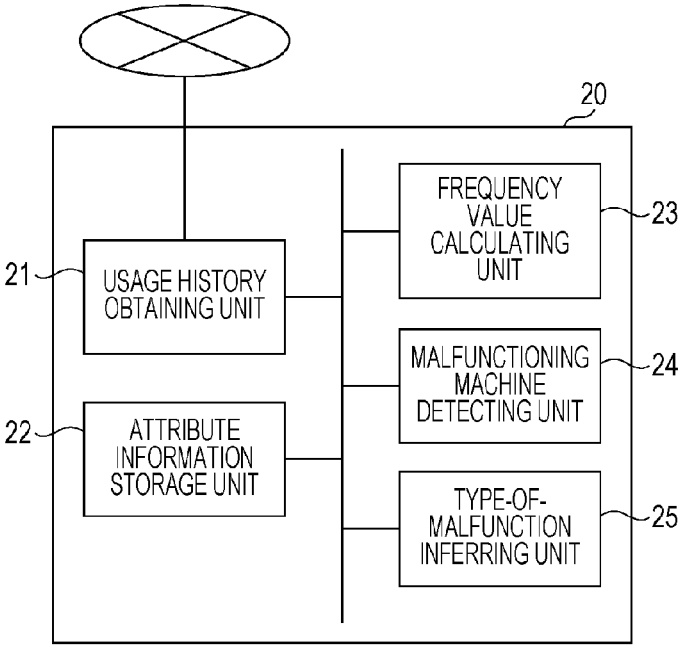
FIG. 2 is a diagram illustrating an example of functional blocks of a management apparatus in the malfunction inferring system.

FIG. 2 illustrates an example of functional blocks of the management apparatus 20 (an example of a malfunction inferring apparatus).

The management apparatus 20 includes a usage history obtaining unit 21, an attribute information storage unit 22, a frequency value calculating unit 23, a malfunctioning machine detecting unit 24, and a type-of-malfunction inferring unit 25.

The usage history obtaining unit 21 obtains usage histories of the individual image forming apparatuses 10 to be monitored. A usage history includes attribute information representing a usage status of the corresponding image forming apparatus 10. Examples of the attribute information include, as illustrated in FIG. 3, identification information about users who have executed print jobs, identification information about files which have been printed in accordance with the print jobs, the number of sheets on which color printing has been performed in accordance with the print jobs, the number of sheets on which monochrome printing has been performed in accordance with the print jobs, and the dates and times when the print jobs were executed.

The attribute information storage unit 22 stores attribute information included in the usage histories obtained by the usage history obtaining unit 21, in association with the identification information about the respective image forming apparatuses 10.

The frequency value calculating unit 23 calculates frequency values related to the attribute information about the individual image forming apparatuses 10, in accordance with the attribute information about the individual image forming apparatuses 10 stored in the attribute information storage unit 22.

The malfunctioning machine detecting unit 24 analyzes the frequency values which are calculated for the individual image forming apparatuses 10 by the frequency value calculating unit 23, and detects an image forming apparatus 10 in which a malfunction is inferred to have occurred.

The type-of-malfunction inferring unit 25 infers, in accordance with a trend of change in the frequency value related to the attribute information about the image forming apparatus 10 detected by the malfunctioning machine detecting unit 24, the type of malfunction which is inferred to have occurred in the image forming apparatus 10.

The information about the malfunctioning machine and the type of malfunction which are detected and inferred by the malfunctioning machine detecting unit 24 and the type-of-malfunction inferring unit 25 is notified to a system administrator or maintainer of the corresponding monitored site. Also, the information is transmitted to the remote center server 30.

Further description will be given of a process of analyzing a malfunctioning machine and the type of malfunction, which is performed by the frequency value calculating unit 23, the malfunctioning machine detecting unit 24, and the type-of-malfunction inferring unit 25.

The management apparatus 20 according to this example performs an analysis process in accordance with the following first to fifth analysis methods.

First Analysis Method

A first analysis method is based on the assumption that one or more regular users and one or more temporary users are set for each of the plural image forming apparatuses 10. A regular user is a user who usually uses the image forming apparatus 10. A temporary user is a user who temporarily uses the image forming apparatus 10 as an alternative to an image forming apparatus 10'.

In this example, usage frequencies of individual users in a past period (a period over which no malfunctions occurred) are calculated for each image forming apparatus 10, the users whose usage frequency is higher than or equal to a reference value are set as regular users, and the users whose usage frequency is lower than the reference value are set as temporary users. The type of user (regular user or temporary user) may be set by using another method. For example, a predetermined number or percentage of users corresponding to the highest usage frequency may be set as regular users, and the other users may be set as temporary users. Alternatively, a system administrator or individual users may explicitly set the type of user. Alternatively, only one or more regular users may be set for each image forming apparatus 10, and the other users may be regarded as temporary users.

The frequency value calculating unit 23 calculates, for each image forming apparatus 10, the number of regular users, the number of temporary users, and the percentage of temporary users (the ratio of the number of temporary users to the total number of users) of the image forming apparatus 10 on each day of a predetermined period.

If there is an image forming apparatus 10 in which the number of regular users is smaller than a reference number for a continuous period of a certain number of days or more, and if there is another image forming apparatus 10' in which the percentage of temporary users is higher than a reference percentage for a continuous period of a certain number of days or more in the same target group as the image forming apparatus 10, the malfunctioning machine detecting unit 24 infers that a malfunction has occurred in the image forming apparatus 10.

As described above, in the first analysis method, the occurrence of a malfunction is inferred in accordance with a change in the trend of users who use the image forming apparatuses 10. This method is based on the following phenomenon.

Figure 4A:
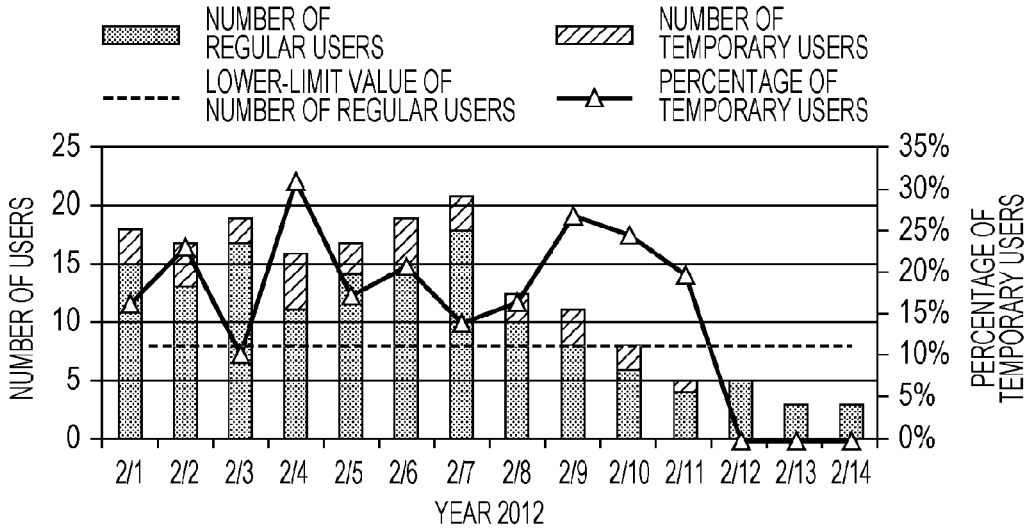
FIGS. 4A and 4B are diagrams illustrating examples of temporal changes in the number of users who have used an image forming apparatus.
Figure 4B:
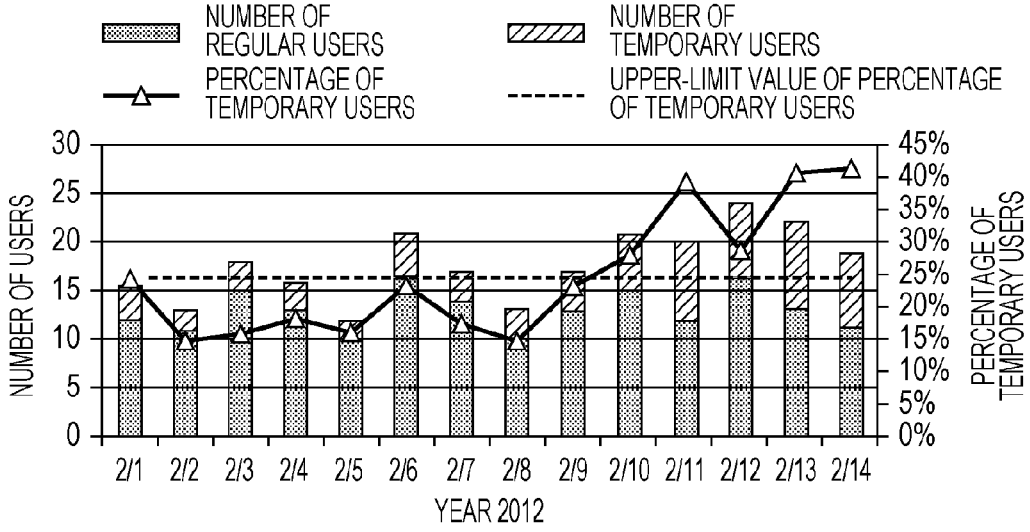

FIGS. 4A and 4B illustrate examples of temporal changes in the number of users who have used the image forming apparatuses 10. FIG. 4A is a graph showing temporal changes in the number of users of a target machine A to be monitored, and FIG. 4B is a graph showing temporal changes in the number of users of a target machine B to be monitored. The target machines A and B belong to the same target group.

In FIGS. 4A and 4B, when the number of regular users of the target machine A becomes smaller than a lower-limit value (reference number), the percentage of temporary users of the target machine B becomes higher than an upper-limit value (reference percentage), and such a situation continues. When such a phenomenon occurs, the possibility is high that some kind of malfunction has occurred in the target machine A and that the regular users of the target machine A are using the target machine B in the same target group as an alternative to the target machine A. In this way, according to the first analysis method, it is inferred that a malfunction has occurred in the target machine A when the above-described phenomenon is detected.

Second Analysis Method

The frequency value calculating unit 23 calculates, for each image forming apparatus 10, the number of events in which a print job of a certain type is executed in the image forming apparatus 10 and then a print job of the certain type is executed in another image forming apparatus 10' in the same target group in a predetermined period.

When the number of events calculated for the image forming apparatus 10 is larger than a reference number, the malfunctioning machine detecting unit 24 infers that a malfunction has occurred in the image forming apparatus 10.

When it is inferred that a malfunction has occurred in the image forming apparatus 10, the type-of-malfunction inferring unit 25 calculates the ratio of the number of monochrome print jobs to the number of color print jobs regarding the plural events on which the inference is based, that is, the individual events in which a print job of a certain type is executed in the image forming apparatus 10 and then a print job of the certain type is executed in another image forming apparatus 10' in the same target group within a period, for example, five minutes. Then, the type-of-malfunction inferring unit 25 infers the type of malfunction that has occurred in the image forming apparatus 10 in accordance with the ratio.

In this example, the ratio of the number of monochrome print jobs to the number of color print jobs (=the number of monochrome print jobs/the number of color print jobs) is calculated, it is inferred that a malfunction related to monochrome printing has occurred if the ratio is higher than or equal to a threshold $\alpha$, it is inferred that a malfunction related to color printing has occurred if the ratio is lower than or equal to a threshold $\beta$ ($\beta<\alpha$), and it is inferred that a malfunction related to wrinkling or paper jam has occurred if the ratio is higher than the threshold $\beta$ and is lower than the threshold $\alpha$.

As described above, in the second analysis method, the occurrence of a malfunction is inferred in accordance with a change in the trend of print jobs executed by the image forming apparatuses 10. This method is based on that, for example, if a print job of a certain type is executed in the target machine A and then a print job of the certain type is executed in the target machine B in the same target group, the possibility is high that some kind of malfunction has occurred in the target machine A and that a print job is being executed in the target machine B in the same target group as an alternative to the target machine A.

Third Analysis Method

A third analysis method is based on the assumption that, in each of the plural image forming apparatuses 10, one or more regular users who usually use the image forming apparatus 10 are set. The setting corresponds to the description given above in the first analysis method, and thus the description thereof is omitted.

Here, it is assumed that the plural image forming apparatuses 10 include a first type of image forming apparatus 10A, which is compatible with monochrome printing and is incompatible with color printing, and a second type of image forming apparatus 10B, which is compatible with both monochrome printing and color printing.

The frequency value calculating unit 23 calculates, for each image forming apparatus 10, the number of print jobs executed in the image forming apparatus 10 by its regular user on each day of a predetermined period. The number of print jobs corresponds to the number of uses of the image forming apparatus 10 by the regular user.

If the ratio of the number of uses of the first type of image forming apparatus 10A to the number of uses of the second type of image forming apparatus 10B (=the number of uses of the image forming apparatus 10A/the number of uses of the image forming apparatus 10B) is higher than a reference ratio, a common regular user being set for the image forming apparatuses 10A and 10B, the malfunctioning machine detecting unit 24 infers that a malfunction has occurred in the image forming apparatus 10B (compatible with both monochrome printing and color printing). As the reference ratio, for example, the sum of an average ratio and a predetermined ratio is used.

As described above, in the third analysis method, the occurrence of a malfunction is inferred in accordance with a change in the trend of the usage ratio of the image forming apparatus 10A (compatible with monochrome printing and incompatible with color printing) to the image forming apparatus 10B (compatible with both monochrome printing and color printing). This method is based on that, if the usage ratio of the image forming apparatus 10A to the image forming apparatus 10B by a common regular user becomes high, the possibility is high that some kind of malfunction has occurred in the image forming apparatus 10B, which had been used for color printing, and that the user has given up performing color printing and using the image forming apparatus 10A, which is in the same target group as the image forming apparatus 10B, as an alternative to the image forming apparatus 10B.

To summarize the above-described first to third analysis methods, these methods are defined as methods for inferring that a malfunction has occurred in any of the plural image forming apparatuses 10 in accordance with changes in the relationship of usage situations among the image forming apparatuses 10 or interrelation of the changes.

Fourth Analysis Method

The frequency value calculating unit 23 calculates, for each image forming apparatus 10, the number of types of print jobs which have been repeatedly executed in a predetermined period. For example, in a case where a print job for document A and a print job for document B are repeatedly executed within five minutes and where a print job for another document is not repeatedly executed, the number of types of print jobs is two.

If the number of types of print jobs which is calculated for the image forming apparatus 10 is larger than a reference number, the malfunctioning machine detecting unit 24 infers that a malfunction has occurred in the image forming apparatus 10.

If it is inferred that a malfunction has occurred in the image forming apparatus 10, the type-of-malfunction inferring unit 25 determines how often a paper feed tray has been changed in accordance with the print jobs which have been repeatedly executed in the image forming apparatus 10, and infers the type of malfunction which has occurred in the image forming apparatus 10 in accordance with the frequency.

In this example, if the frequency is higher than or equal to a reference frequency, it is inferred that a malfunction related to wrinkling or paper jam has occurred. If the frequency is lower than the reference frequency, it is inferred that a malfunction related to poor image quality has occurred.

Figure 5A:
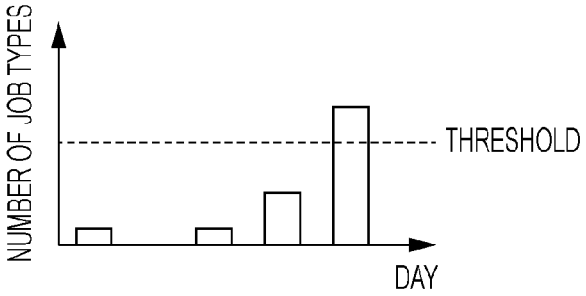
FIGS. 5A and 5B are diagrams illustrating examples of temporal changes in the number of types of jobs executed in an image forming apparatus.
Figure 5B:
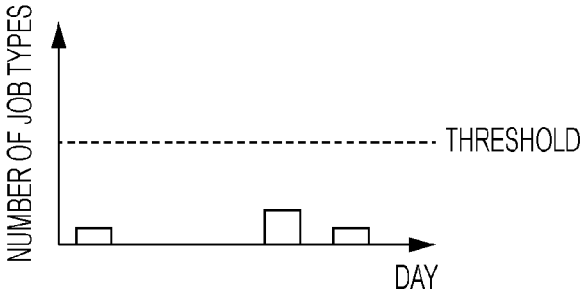

As described above, in the fourth analysis method, the occurrence of a malfunction is inferred in accordance with the number of types of print jobs which have been executed in the image forming apparatus 10. This is based on that, if the same type of print jobs have been repeatedly executed, the possibility is high that some kind of malfunction has occurred in the image forming apparatus 10 but a print job is being executed again in the same image forming apparatus 10 for confirmation. FIG. 5A illustrates an example of temporal changes in the number of types of jobs in an image forming apparatus 10 in which a malfunction has occurred. FIG. 5B illustrates an example of temporal changes in the number of types of jobs in a normal image forming apparatus 10.

Fifth Analysis Method

The frequency value calculating unit 23 calculates, for each image forming apparatus 10, a monochrome to color ratio regarding the print jobs executed in the image forming apparatus 10 on each day of a predetermined period. The monochrome to color ratio is the ratio of the number of monochrome print jobs to the number of color print jobs.

If the monochrome to color ratio calculated for the image forming apparatus 10 is higher than a reference ratio, the malfunctioning machine detecting unit 24 infers that a malfunction has occurred in the image forming apparatus 10. As the reference ratio, for example, the sum of an average ratio and a predetermined ratio is used.

If it is inferred that a malfunction has occurred in the image forming apparatus 10, the type-of-malfunction inferring unit 25 infers that the type of malfunction that has occurred in the image forming apparatus 10 is a malfunction related to poor color image quality.

As described above, in the fifth analysis method, the occurrence of a malfunction is inferred in accordance with the monochrome to color ratio about print jobs executed in the image forming apparatus 10. This method is based on that, if the ratio of monochrome print jobs executed in the image forming apparatus 10 becomes high, the possibility is high that a malfunction related to poor color image quality has occurred in the image forming apparatus 10, and that the user has given up performing color printing and is performing monochrome printing.

In any of the first to fifth analysis methods, it is not necessary to collect various image formation parameters for controlling the operation of the image forming function and examine time-series changes of the parameters. Thus, it is not necessary for the image forming apparatus 10 to have a function of detecting image formation parameters and storing the parameters in an internal memory or the like, and thus the occurrence of a malfunction may be inferred for the image forming apparatus 10 having a small number of resources such as a memory capacity.

In the description given above, the first to fifth analysis methods have been individually described. However, these methods may be combined together to infer a malfunction of the image forming apparatus 10.

Figure 6:
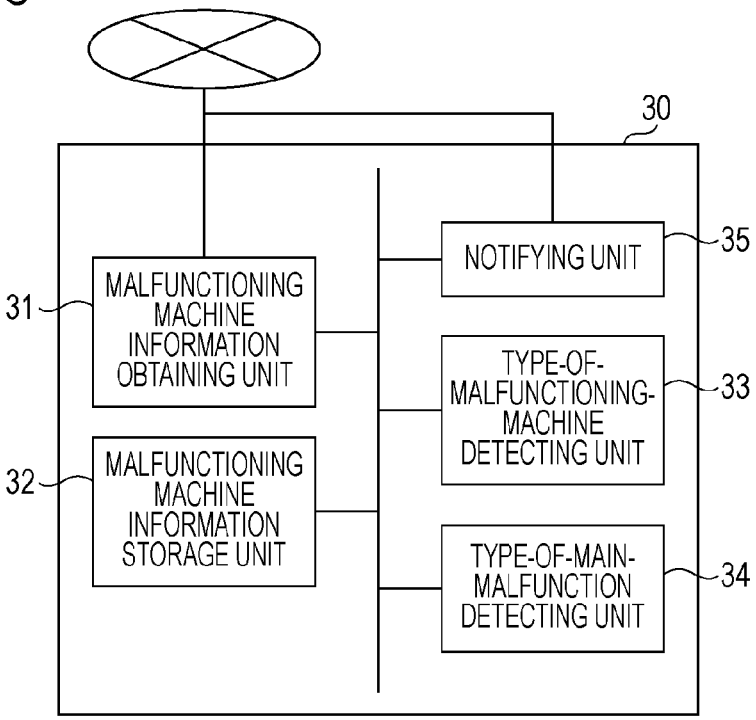
FIG. 6 is a diagram illustrating an example of functional blocks of a remote center server in the malfunction inferring system.

FIG. 6 illustrates an example of functional blocks of the remote center server 30.

The remote center server 30 includes a malfunctioning machine information obtaining unit 31, a malfunctioning machine information storage unit 32, a type-of-malfunctioning-machine detecting unit 33, a type-of-main-malfunction detecting unit 34, and a notifying unit 35.

The malfunctioning machine information obtaining unit 31 receives, from the management apparatus 20 which is provided for a corresponding one of monitored sites, malfunctioning machine information including information about the type of image forming apparatus 10 in which the occurrence of a malfunction has been inferred and the type of malfunction.

The malfunctioning machine information storage unit 32 stores the malfunctioning machine information obtained by the malfunctioning machine information obtaining unit 31.

The type-of-malfunctioning-machine detecting unit 33 analyzes, for each type of image forming apparatuses 10, the number of image forming apparatuses 10 (the number of machines) in which a malfunction is inferred to have occurred, in accordance with the malfunctioning machine information stored in the malfunctioning machine information storage unit 32, and detects a type of machine in which the number of occurrences of malfunction is increasing. Specifically, for example, the type-of-malfunctioning-machine detecting unit 33 obtains, for each type of image forming apparatuses 10, a regression line representing the daily transition of the number of machines in which a malfunction has occurred for the latest five days. If the slope of the regression line is larger than or equal to a reference value, the type-of-malfunctioning-machine detecting unit 33 detects the type corresponding to the regression line as a type of machine in which the number of occurrences of a malfunction is increasing.

The type-of-main-malfunction detecting unit 34 detects, regarding the type of image forming apparatus 10 detected by the type-of-malfunctioning-machine detecting unit 33, the type of main malfunction among the types of malfunction inferred to have occurred in the image forming apparatuses 10 of the detected type. The type of main malfunction is determined in the following manner, for example. For each type of malfunction, the number of image forming apparatuses 10 in which the malfunction of the type is inferred to have occurred is obtained. Then, plural types of malfunction corresponding to a large number of machines (a predetermined number or percentage of machines) are regarded as the types of main malfunction.

The notifying unit 35 notifies the system administrator or maintainer of the monitored site including the image forming apparatuses 10 of the type detected by the type-of-malfunctioning-machine detecting unit 33, of the types of main malfunction detected by the type-of-main-malfunction detecting unit 34. The notified types are regarded as candidate types of malfunction which may occur in the corresponding image forming apparatuses 10.

In this way, in the remote center server 30, the types of malfunction which may occur in the image forming apparatuses 10 are detected for each type of image forming apparatuses 10 in accordance with the malfunctioning machine information transmitted from plural monitored sites, and the detected types are notified as candidate types to the system administrator or maintainer of each monitored site. Accordingly, in each monitored site, appropriate measures may be taken before a malfunction occurs (or immediately after a malfunction has occurred).

The management apparatus 20 according to this example includes a computer provided with hardware resources, including a central processing unit (CPU) that performs various types of processing; main storage devices such as a random access memory (RAM) serving as a working area for the CPU and a read only memory (ROM) having a basic control program recorded thereon; an auxiliary storage device such as a hard disk drive (HDD) that stores various programs and data; an input/output interface serving as an interface for a display device that displays various pieces of information and an input device such as an operation button and a touch panel that are used by an operator to perform an input operation; and a communication interface serving as an interface for performing wired or wireless communication with another apparatus.

A program according to an exemplary embodiment of the present invention is read out from the auxiliary storage device and is expanded on the RAM, and is executed by the CPU. Accordingly, the functions of the malfunction inferring apparatus according to an exemplary embodiment of the present invention are realized in the computer of the management apparatus 20.

In this example, the function of an obtaining unit according to an exemplary embodiment of the present invention is realized by the usage history obtaining unit 21, and the function of an inferring unit according to an exemplary embodiment of the present invention is realized by the frequency value calculating unit 23 and the malfunctioning machine detecting unit 24 (and the type-of-malfunction inferring unit 25).

Here, the program according to the exemplary embodiment of the present invention is set into the computer of an image forming apparatus in the form of being read from an external storage medium, such as a CD-ROM storing the program, or in the form of being received via a communication network or the like.

The individual functional units may be realized using the above-described software configuration, or may be realized using dedicated hardware modules.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A malfunction inferring apparatus comprising:

an obtaining unit configured to obtain, from a first image forming apparatus and a second image forming apparatus which are used alternatively with each other by a plurality of users, a first usage history of the first image forming apparatus and a second usage history of the second image forming apparatus; and an inferring unit configured to, in response to a first change occurring in the first usage history and a second change corresponding to the first change occurring in the second usage history, infer that a malfunction has occurred in any one of the first image forming apparatus and the second image forming apparatus, in accordance with the first usage history and the second usage history obtained by the obtaining unit, and wherein the inferring unit is configured to infer that a malfunction has occurred in the first image forming apparatus in response to a number of regular users who have used the first image forming apparatus being smaller than a reference number and a ratio of the number of temporary users of the second image forming apparatus to a number of users who have used the second image forming apparatus being higher than a reference ratio.

2. The malfunction inferring apparatus according to claim 1, further comprising:

a memory configured to store, for each of the first image forming apparatus and the second image forming apparatus, information about one or more regular users who regularly use the image forming apparatus and information about one or more temporary users who use the image forming apparatus as an alternative to another image forming apparatus, and wherein the obtaining unit is configured to obtain, as the first usage history and the second usage history, information about users who have used the first image forming apparatus for a period and information about users who have used the second image forming apparatus for the period.

3. A malfunction inferring apparatus comprising:

an obtaining unit configured to obtain, from a first image forming apparatus and a second image forming apparatus which are used alternatively with each other by a plurality of users, a first usage history of the first image forming apparatus and a second usage history of the second image forming apparatus; and an inferring unit configured to, in response to a first change occurring in the first usage history and a second change corresponding to the first change occurring in the second usage history, infer that a malfunction has occurred in any one of the first image forming apparatus and the second image forming apparatus, in accordance with the first usage history and the second usage history obtained by the obtaining unit, wherein the inferring unit is configured to infer that a malfunction has occurred in the first image forming apparatus in response to a number of events in which a print job of a certain type is executed by the first image forming apparatus and then a print job of the certain type is executed by the second image forming apparatus being larger than a reference number.

4. The malfunction inferring apparatus according to claim 3, wherein the obtaining unit is configured to obtain, as the first usage history and the second usage history, information about print jobs that have been executed by the first image forming apparatus and information about print jobs that have been executed by the second image forming apparatus.

5. The malfunction inferring apparatus according to claim 4, wherein the information about print jobs includes information representing monochrome printing or color printing, and wherein, after inferring that a malfunction has occurred in the first image forming apparatus, the inferring unit further obtains a ratio of the number of monochrome print jobs to the number of color print jobs in the events on which the inference is based, and infers, in accordance with the obtained ratio, whether the malfunction which has been inferred to have occurred in the first image forming apparatus is a malfunction related to monochrome printing, a malfunction related to color printing, or a malfunction of another type.

6. A malfunction inferring apparatus comprising:

an obtaining unit that is configured to obtain, from a first image forming apparatus and a second image forming apparatus which are used alternatively with each other by a plurality of users, a first usage history of the first image forming apparatus and a second usage history of the second image forming apparatus; and an inferring unit configured to, in response to a first change occurring in the first usage history and a second change corresponding to the first change occurring in the second usage history, infer that a malfunction has occurred in any one of the first image forming apparatus and the second image forming apparatus, in accordance with the first usage history and the second usage history obtained by the obtaining unit, and wherein the inferring unit is configured to infer that a malfunction has occurred in the first image forming apparatus in response to: (1) there being common regular users who regularly use both of the first image forming apparatus and the second image forming apparatus, and (2) a ratio of the number of uses of the second image forming apparatus by the common regular users to the number of uses of the first image forming apparatus by the common regular users being higher than a reference ratio.

7. The malfunction inferring apparatus according to claim 6, further comprising:

a memory configured to store, for each of the first image forming apparatus and the second image forming apparatus, information about one or more regular users who regularly use the image forming apparatus, and wherein the obtaining unit is configured to obtain, as the first usage history and the second usage history, information about users who have used the first image forming apparatus and information about users who have used the second image forming apparatus.

* * * * *